US008949116B2

(12) United States Patent
Kim

(10) Patent No.: US 8,949,116 B2
(45) Date of Patent: Feb. 3, 2015

(54) SIGNAL PROCESSING METHOD AND APPARATUS FOR AMPLIFYING SPEECH SIGNALS

(75) Inventor: Jae-Hyun Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 655 days.

(21) Appl. No.: 13/016,069

(22) Filed: Jan. 28, 2011

(65) Prior Publication Data

US 2011/0184731 A1 Jul. 28, 2011

(30) Foreign Application Priority Data

Jan. 28, 2010 (KR) ..... 10-2010-0008049

(51) Int. Cl.
*G10L 21/00* (2013.01)
*G10L 21/038* (2013.01)
*G10L 19/008* (2013.01)

(52) U.S. Cl.
CPC ..... *G10L 21/038* (2013.01); *G10L 19/008* (2013.01)
USPC ..... 704/205; 704/206; 704/207; 704/208; 704/209

(58) Field of Classification Search
USPC ..... 704/205–209
See application file for complete search history.

(56) References Cited

U.S. PATENT DOCUMENTS

| | | | | |
|---|---|---|---|---|
| 4,698,842 | A * | 10/1987 | Mackie et al. | 381/1 |
| 4,866,774 | A | 9/1989 | Klayman | |
| 5,555,190 | A * | 9/1996 | Derby et al. | 702/45 |
| 7,676,043 | B1 * | 3/2010 | Tsutsui et al. | 381/1 |
| 2004/0138888 | A1 * | 7/2004 | Ramabadran | 704/262 |
| 2006/0050898 | A1 * | 3/2006 | Yamada et al. | 381/104 |
| 2009/0304203 | A1 * | 12/2009 | Haykin et al. | 381/94.1 |

FOREIGN PATENT DOCUMENTS

| | | | |
|---|---|---|---|
| EP | 0994464 | A1 | 4/2000 |
| WO | 98/57436 | A2 | 12/1998 |
| WO | 2004/093494 | A1 | 10/2004 |

OTHER PUBLICATIONS

Search Report dated Apr. 20, 2011 from the European Patent Office in counterpart application No. 11151908.8.

* cited by examiner

*Primary Examiner* — Leonard Saint Cyr
(74) *Attorney, Agent, or Firm* — Sughrue Mion, PLLC

(57) ABSTRACT

A signal processing method is provided. The signal processing method includes extracting a first signal having a first frequency band from a sum signal of a left signal and a right signal, generating a second signal having a second frequency band by using the first signal, generating a third signal by using the first signal and the second signal, and applying a gain, generated by using a rate of a center signal included in the sum signal, to the third signal.

29 Claims, 7 Drawing Sheets
(1 of 7 Drawing Sheet(s) Filed in Color)

SIGNAL PROCESSING METHOD AND APPARATUS FOR AMPLIFYING SPEECH SIGNALS

CROSS-REFERENCE TO RELATED PATENT APPLICATION

This application claims priority from Korean Patent Application No. 10-2010-0008049, filed on Jan. 28, 2010, in the Korean Intellectual Property Office, the disclosure of which is incorporated herein in its entirety by reference.

BACKGROUND

1. Field

Methods and apparatuses consistent with the exemplary embodiments relate to a signal processing method and apparatus, and more particularly, to a signal processing method and apparatus which improves the articulation of a speech signal included in an audio signal by using harmonics.

2. Description of the Related Art

As devices for outputting an audio signal tend to be slim and compact, sound quality deterioration of a speech signal included in the audio signal further worsens. When the speech signal includes noise or a performance signal such as the sound of a musical instrument, the speech signal is difficult to hear due to the noise or the performance signal. Therefore, a method of amplifying a speech signal is required.

Generally, human ears do not perceive sounds of all frequencies as having equal loudness. That is, for signals of an identical magnitude, the human ears perceive a signal of a particular frequency as being loud and do not perceive a signal of another particular frequency as being loud. Accordingly, there is a need for a method of amplifying a speech signal considering auditory characteristics of humans.

SUMMARY

The exemplary embodiments provide a method and apparatus for amplifying a speech signal by generating a harmonic component in a human-sensitive frequency band that humans can hear best, based on a signal of a frequency band in which speech signals are distributed as a fundamental wave.

The exemplary embodiments also provide a method and apparatus for predicting a rate of a speech signal included in a stereo signal and adjusting a magnitude of the speech signal by using the predicted rate.

According to an aspect of the exemplary embodiments, there is provided a signal processing method including extracting a first signal having a first frequency band from a sum signal of a left signal and a right signal, generating a second signal having a second frequency band by using the first signal, generating a third signal by using the first signal and the second signal, and applying a gain, generated with a rate of a center signal included in the sum signal, to the third signal.

In an exemplary embodiment, the generating of the second signal may include generating harmonics for a fundamental wave by using the first signal as the fundamental wave, and generating a signal included in the second frequency band among the harmonics as the second signal. The signal processing method may further include applying a weight filter to the second signal.

The generating of the second signal may include dividing the first signal into signals of N frequency bands and extracting a signal of an $M^{th}$ frequency band from among the signals of the N frequency bands, N being a natural number greater than 2 and M being a natural number less than or equal to N, generating harmonics by using the signal of the $M^{th}$ frequency band as a fundamental wave, extracting harmonics included in the $M^{th}$ frequency band among N frequency bands included in the second frequency band from among the generated harmonics, and generating the second signal by adding harmonics extracted from each of the N frequency bands included in the second frequency band when each of the signals of the N frequency bands of the first signal is used as a fundamental wave. The signal processing method may further include applying a weight filter to the second signal.

The applying of the weight filter may include applying a weight filter having a separate weight for each of the N frequency bands included in the second frequency band, and the weight filter has a relatively small weight for a high-frequency band, the weight being a real number not less than 0 and not more than 1. The applying of the weight filter may include applying a frequency weight filter having a relatively small weight for a high frequency, the weight being a positive real number not more than 1.

The generating of the third signal may include time-delaying the first signal, and generating the third signal by adding the second signal filtered by the weight filter to the time-delayed first signal. The applying of the gain may include calculating a sum signal and a difference signal of the left signal and the right signal on each frame basis; calculating a rate of the difference signal to the sum signal and calculating a rate of the center signal included in the sum signal by using the rate of the difference signal on each frame basis; and generating a product of the rate of the center signal and K as a gain for each frame, K being a positive real number.

The calculating of the rate of the center signal may include normalizing the rate of the difference signal included in the sum signal and subtracting the normalized rate from 1, thereby calculating the rate of the center signal. The applying of the gain may include applying a gain obtained for each frame to the third signal on a frame basis. The signal processing method may further include time-delaying the left signal and the right signal and generating a new left signal and a new right signal by adding the signal to which the gain was applied to each of the time-delayed left signal and the time-delayed right signal. The second frequency band may have frequency values greater than those of the first frequency band. The second frequency band may have a size that is twice the size of the first frequency band.

According to another aspect of the exemplary embodiments, there is provided a signal processing apparatus including a first signal extracting unit for extracting a first signal having a first frequency band from a sum signal of a left signal and a right signal, a gain generating unit for generating a gain by using a rate of a center signal included in the sum signal, and an extension signal generating unit for generating a second signal having a second frequency band by using the first signal, generating a third signal by using the first signal and the second signal, and applying the gain to the third signal.

According to another aspect of the exemplary embodiments, there is provided a computer-readable recording medium having embodied thereon a program for executing a signal processing method, the signal processing method including extracting a first signal having a first frequency band from a sum signal of a left signal and a right signal, generating a second signal having a second frequency band by using the first signal, generating a third signal by using the first signal and the second signal, and applying a gain, generated by using a rate of a center signal included in the sum signal, to the third signal.

According to the exemplary embodiments, a method and apparatus for amplifying a speech signal by extending the speech signal to a human-sensitive frequency band is provided.

Moreover, according to the exemplary embodiments, a method and apparatus for adjusting the magnitude of a speech signal based on a rate of the speech signal included in a stereo signal is provided.

BRIEF DESCRIPTION OF THE DRAWINGS

The patent or application file contains at least one drawing executed in color. Copies of this patent or patent application publication with color drawing(s) will be provided by the Office upon request and payment of the necessary fee. The above and other aspects will become more apparent by describing in detail exemplary embodiments thereof with reference to the attached drawings in which.

DETAILED DESCRIPTION OF THE EXEMPLARY EMBODIMENTS

Hereinafter, an exemplary embodiment will be described in detail with reference to the accompanying drawings.

Figure 1:
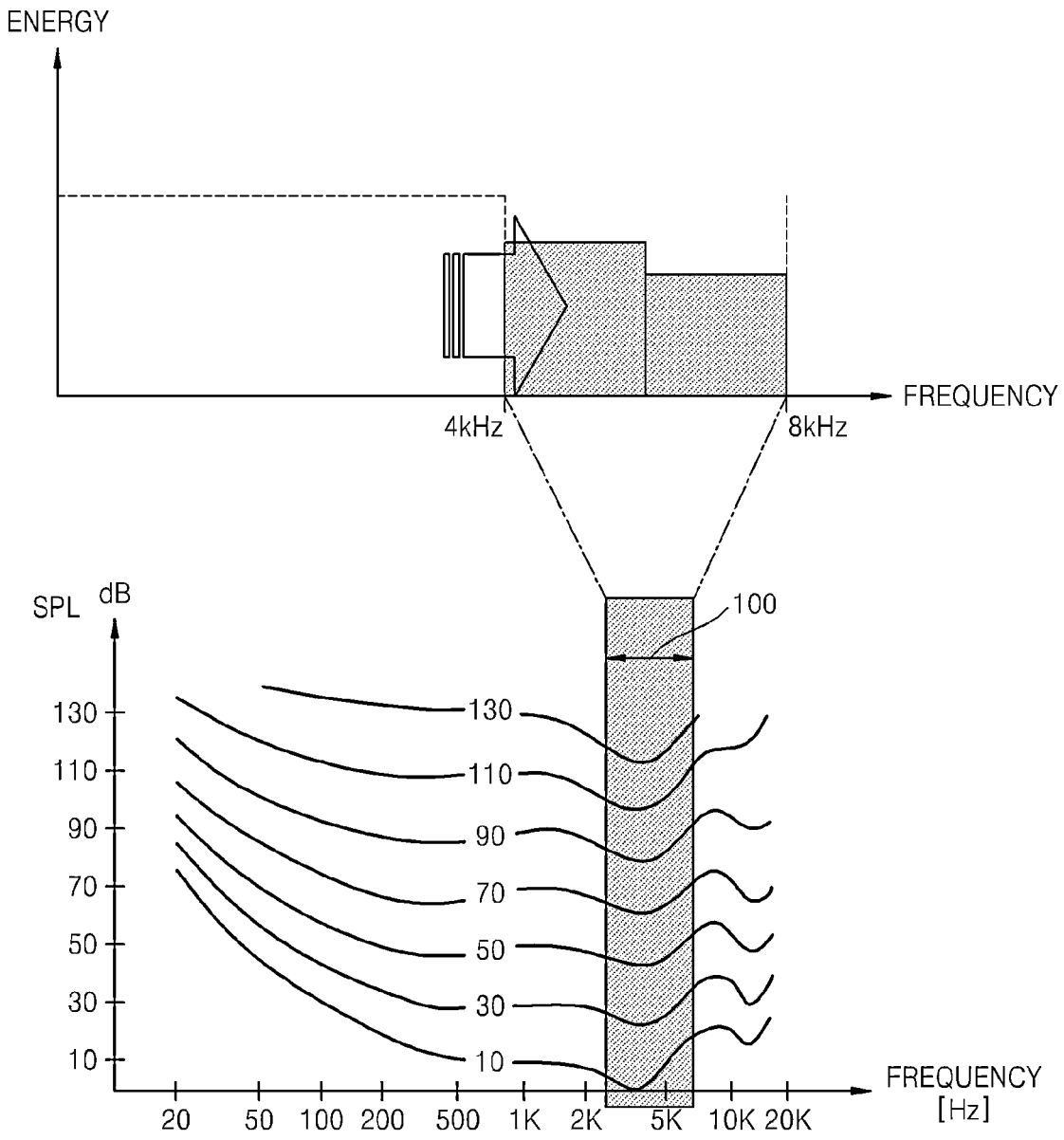
FIG. 1 is a view for explaining a signal processing method according to an exemplary embodiment.

FIG. 1 is a view for explaining a signal processing method according to an exemplary embodiment. In FIG. 1, the lower graph shows equal-loudness contours. In the lower graph, a horizontal axis indicates frequency and a vertical axis indicates soundness pressure level (SPL).

Human ears cannot perceive sounds of all frequencies as having equal loudness. An equal-loudness contour is a curve which ties up sound pressure levels that humans feel as having equal loudness with respect to frequency. In an equal-loudness contour, a low sound pressure means that humans are sensitive to a signal of a corresponding frequency band and a high sound pressure level means that humans are not sensitive to a signal of a corresponding frequency band.

Generally, human speech signals are distributed in a frequency band of about 340 Hz to 3-4 KHz. However, as can be seen from the equal loudness contours shown in FIG. 1, a frequency band where speech signals are distributed does not completely match a frequency band to which humans are sensitive. That is, no speech signals are distributed in a frequency band of about 3-4 KHz to 7-8 KHz in the human-sensitive frequency band. In the equal-loudness contour graph shown in FIG. 1, such a frequency band where no speech signals are distributed in the human-sensitive frequency band is assumed to range from 4 KHz to 8 KHz and is indicated by reference numeral 100.

In FIG. 1, the upper graph is intended to explain generating a new signal in the frequency band 100 where no speech signals are distributed in the human-sensitive frequency band, by using a speech signal. In the upper graph shown in FIG. 1, a horizontal axis indicates frequency and a vertical axis indicates speech signal energy.

In the upper graph shown in FIG. 1, a speech signal is assumed to be present in a frequency band of below 4 KHz for the sake of convenience. However, such an assumption is merely an example, and the speech signal may be assumed to be present in another frequency band, for example, a frequency band of 350 HZ to 3.5 KHz.

In the upper graph shown in FIG. 1, an arrow points to the right with respect to the frequency band where a speech signal is located. This arrow means that a new signal is generated to the right with respect to the frequency band where a speech signal is located, that is, in a frequency band higher than the frequency band where a speech signal is located. In other words, in an exemplary embodiment, in a frequency band, which is included in the human-sensitive frequency band, but does not overlap with the frequency band where a speech signal is located, for example, the frequency band 100 of 4 KHz to 8 KHz, a new signal is generated and is used together with the original speech signal.

According to the current exemplary embodiment, by generating the new signal in the human-sensitive frequency band and using the new signal and the speech signal as a new speech signal, the frequency band of the speech signal can be extended to a frequency band based on auditory characteristics of humans.

Figure 2:
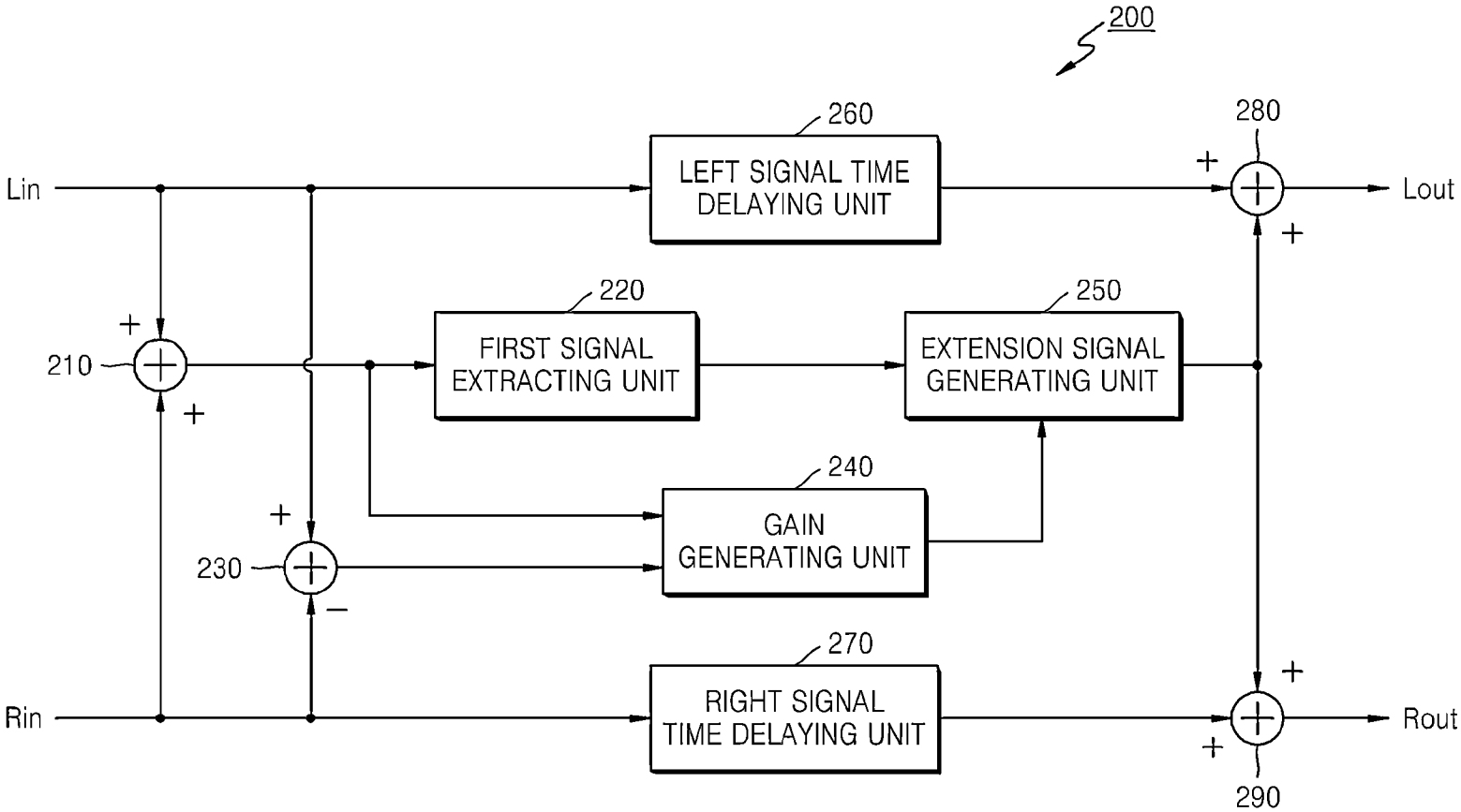
FIG. 2 is a diagram of a signal processing apparatus according to an exemplary embodiment.

FIG. 2 is a diagram of a signal processing apparatus 200 according to an exemplary embodiment. Referring to FIG. 2, the signal processing apparatus 200 includes a sum signal generating unit 210, a difference signal generating unit 230, a first signal extracting unit 220, an extension signal generating unit 250, a gain generating unit 240, a left signal time delaying unit 260, a right signal time delaying unit 270, and stereo signal generating units 280 and 290.

The sum signal generating unit 210 generates a sum signal by adding a left signal Lin and a right signal Rin which form a stereo signal. The sum signal generating unit 210 outputs the generated sum signal to the first signal extracting unit 220 and the gain generating unit 240.

The difference signal generating unit 230 generates a difference signal by subtracting the right signal Rin from the left signal Lin or subtracting the left signal Lin from the right signal Rin. The difference signal generating unit 230 outputs the difference signal to the gain generating unit 240.

The first signal extracting unit 220 extracts a first signal having a first frequency band from the sum signal output from the sum signal generating unit 210. In an exemplary embodiment, the first frequency band may be a frequency band where a speech signal is located, and the first signal may be a signal of the sum signal, which is located in the frequency band where a speech signal is located. The first frequency band may be preset in the signal processing apparatus 200. For example, in the signal processing apparatus 200, the first frequency band may be previously set to be from 2 KHz to 4 KHz.

The first signal extracting unit 220 extracts the first signal located in the first frequency band and outputs the extracted first signal to the extension signal generating unit 250.

The gain generating unit 240 generates a gain by using the sum signal output from the sum signal generating unit 210 and the difference signal output from the difference signal generating unit 230. The gain generating unit 240 calculates a rate of the difference signal included in the sum signal by dividing the difference signal by the sum signal, and calculates a rate of a center signal included in the sum signal by using the rate of the difference signal.

The center signal refers to a signal which is included identically both in the left signal Lin and the right signal Rin. Generally, a speech signal is the center signal because of being included identically both in a left signal and a right signal.

The gain generating unit 240 generates the rate of the center signal as a gain or generates a product of the rate of the center signal and a correction factor as a gain. The gain generating unit 240 outputs the gain to the extension signal generating unit 250.

The extension signal generating unit 250 generates a second signal having a second frequency band by using the first signal having the first frequency band. In an exemplary embodiment, the second frequency band may be a frequency band which does not overlap with the first frequency band included in a human-sensitive frequency band based on the equal-loudness contours.

The extension signal generating unit 250 may compare sound pressure levels of the equal-loudness contours with a predetermined threshold and set a frequency band which does not overlap with the first frequency band among frequency bands having lower sound pressure levels than the predetermined threshold as the second frequency band. In another embodiment, the second frequency band may be preset in the signal processing apparatus 200. For example, in the signal processing apparatus 200, the second frequency band may be previously set to be from 4 KHz to 8 KHz.

The extension signal generating unit 250 generates harmonics having a frequency which is a multiple of a fundamental wave by using the first signal as the fundamental wave. For a fundamental wave, $L^{th}$-order harmonics having a frequency which is L times a frequency of the fundamental wave. Herein, L is a natural number greater than 2. The extension signal generating unit 250 extracts harmonics included in the human-sensitive frequency band, that is, the second frequency band, from among the $L^{th}$-order harmonics generated for the fundamental wave, and generates the extracted harmonics as the second signal.

The extension signal generating unit 250 may process the first frequency band where the first signal is located as a single band, and may divide the first frequency band into N frequency bands and generate harmonics by using signals of the N frequency bands as fundamental waves. Herein, N is a natural number greater than 2. In this case, the extension signal generating unit 250 may extract harmonics included in a predetermined frequency band from among harmonics generated by using a signal of a predetermined frequency band as a fundamental wave, and add the extracted harmonics together, thereby generating the second signal. This will be described in more detail with reference to FIG. 3.

The extension signal generating unit 250 generates a new speech signal by adding the first signal and the second signal. The extension signal generating unit 250 applies the gain output from the gain generating unit 240 to a signal which is a sum of the first signal and the second signal. As discussed above, since the gain indicates the rate of the center signal included in the stereo signal, the more the center signal is included in the stereo signal, the greater the gain becomes, whereby the signal which is the sum of the first signal and the second signal also increases. On the other hand, the less the center signal is included in the stereo signal, the less the gain becomes, whereby the signal which is the sum of the first signal and the second signal also decreases.

The extension signal generating unit 250 outputs the gain-applied signal to the stereo signal generating units 280 and 290.

The left signal time delaying unit 260 and the right signal time delaying unit 270 respectively delay the left signal Lin and the right signal Rin by predetermined times. The left signal time delaying unit 260 and the right signal time delaying unit 270 correct a time delay in the signal processing apparatus 200 to prevent an out-of-phase phenomenon during signal mixing of the stereo signal generating units 280 and 290. The stereo signal generating units 280 and 290 generate a new stereo signal including a new left signal Lout and a new right signal Rout by adding the gain-applied signal to the time-delayed left signal Lin and the time-delayed right signal Rin.

As such, according to an exemplary embodiment, by generating harmonics for a speech signal in the human-sensitive frequency band, the speech signal can be heard clearly.

According to an exemplary embodiment, a gain is generated by using a rate of the center signal included in the stereo signal and the generated gain is applied to the first signal and the second signal, thereby adjusting the magnitude of a signal based on the rate of the speech signal included in the stereo signal.

Figure 3:
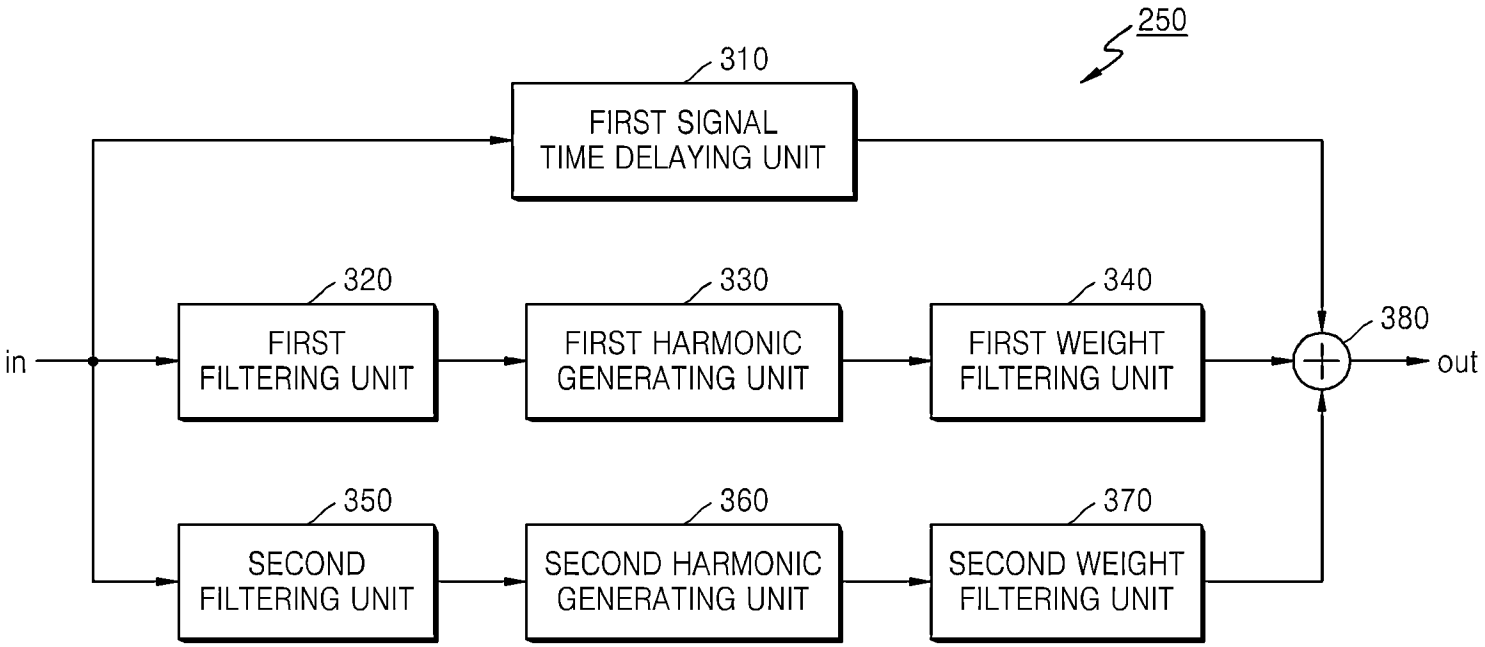
FIG. 3 is a diagram of an extension signal generating unit shown in FIG. 2, according to an exemplary embodiment.

FIG. 3 is a diagram of the extension signal generating unit 250 shown in FIG. 2, according to an exemplary embodiment. Referring to FIG. 3, the extension signal generating unit 250 includes a first signal time delaying unit 310, a first filtering unit 320, a second filtering unit 350, a first harmonic generating unit 330, a second harmonic generating unit 360, a first weight filtering unit 340, a second weight filtering unit 370, and a signal adding unit 380.

The first signal time delaying unit 310 corrects a time delay in the extension signal generating unit 250 to prevent an out-of-phase phenomenon when the signal adding unit 380 adds signals filtered by the first weight filtering unit 340 and the second weight filtering unit 370 to the first signal.

The extension signal generating unit 250 includes two filtering units, namely, the first filtering unit 320 and second filtering unit 350, but the exemplary embodiments are not limited thereto, and the extension signal generating unit 250 may include one or more filtering units. The filtering units may be band pass filters (BPF) that extract a signal of a predetermined frequency band. Herein, N is a natural number greater than or equal to 2. If the extension signal generating unit 250 includes a plurality of filtering units, the number of harmonic generating units (or weight filtering units) included in the extension signal generating unit 250 is the same as the number of filtering units.

If N filtering units are included in the extension signal generating unit 250, the N filtering units respectively extract signals from N frequency bands divided from the first frequency band, that is, the N frequency bands, each having a size of 1/N times the first frequency band. In other words, an $M^{th}$ filtering unit from among the N filtering units extracts a signal from an $M^{th}$ frequency band of N frequency bands when the first frequency band is divided into N frequency bands. Herein, M is a natural number less than or equal to N.

The N harmonic generating units generate harmonics by using the signals extracted from the N frequency bands by the N filtering units as fundamental waves. That is, an $M^{th}$ harmonic generating unit from among the N harmonic generating units generates harmonics by using a signal extracted from the $M^{th}$ frequency band included in the first frequency band as a fundamental wave.

The N weight filtering units respectively extract harmonics from N frequency bands divided from the second frequency band, like the first frequency band, that is, the N frequency bands, each having a size of 1/N times the second frequency band. In other words, an $M^{th}$ weight filtering unit from among the N weight filtering units extracts harmonics from an $M^{th}$ frequency band among the harmonics generated by the $M^{th}$ harmonic generating unit when the second frequency band is divided into the N frequency bands.

The N weight filtering units may apply weight filters having separate weights to the N frequency bands from which harmonics are extracted. Since one finds it unpleasant when hearing a signal of a high frequency, the N weight filtering units may apply weight filters to the N frequency bands included in the second frequency band in such a way that a weight filter having a smaller weight is applied to a higher frequency band.

In FIG. 3, it is shown that the number of filtering units N, is 2. Referring to FIG. 3, the first signal and filter signals of predetermined frequency bands from the first signal are input to the first filtering unit 320 and the second filtering unit 350.

The first filtering unit 320 extracts a signal included in a frequency band having a size of ½ of the first frequency band and the second filtering unit 350 extracts a signal included in the remaining of the frequency band. For example, if the first frequency band ranges from 2 KHz to 4 KHz, the first filtering unit 320 extracts a signal having a frequency band of 2 KHz to 3 KHz from the first signal and the second filtering unit 350 extracts a signal having a frequency band of 3 KHz to 4 KHz from the first signal.

The first filtering unit 320 outputs the extracted signal to the first harmonic generating unit 330, and the second filtering unit 350 outputs the extracted signal to the second harmonic generating unit 360. The first harmonic generating unit 330 generates harmonics by using the signal having a frequency band of 2 KHz to 3 KHz extracted by the first filtering unit 320 as a fundamental wave. The second harmonic generating unit 360 generates harmonics by using the signal having a frequency band of 3 KHz to 4 KHz extracted by the second filtering unit 350 as a fundamental wave.

The first harmonic generating unit 330 and the second harmonic generating unit 360 generate $L^{th}$-order harmonics having a frequency that is L times a frequency of a fundamental wave, by using a nonlinear device. Herein, L is a natural number greater than 2. When a signal input to the first harmonic generating unit 330 is x(n) and harmonics output from the first harmonic generating unit 330 is y(n), the first harmonic generating unit 330 may generate harmonics by using various methods including the following equations.

$$y(n)=|x(n)| \tag{1}$$

$$y(n)=\text{sign}(x(n))(|x(n)|-x(n)\hat{}2) \tag{2}$$

$$y(n)=0;((x(n)<0),y(n)=x(n)(x(n)>=0) \tag{3}$$

The second harmonic generating unit 360 may generate harmonics in the same manner as the first harmonic generating unit 330.

The first weight filtering unit 340 extracts harmonics included in a frequency band having a size of ½ times the second frequency band, from among the harmonics generated by the first harmonic generating unit 330. For example, if the second frequency band ranges from 4 KHz to 8 KHz, the first weight filtering unit 340 extracts harmonics included in a frequency band of 4 KHz to 6 KHz. Likewise, the second weight filtering unit 370 extracts harmonics included in a frequency band of 6 KHz to 8 KHz from among the harmonics generated by the second harmonic generating unit 360.

The first weight filtering unit 340 and the second weight filtering unit 370 may extract harmonics by applying predetermined weights to frequency bands. That is, the first weight filtering unit 340 may extract harmonics by applying a predetermined first weight to a frequency band of 4 KHz to 6 KHz included in the second frequency band, and the second weight filtering unit 370 may extract harmonics by applying a predetermined second weight to a frequency band of 6 KHz to 8 KHz. It is preferable that the weights be positive real numbers less than or equal to 1.

The first weight filtering unit 340 and the second weight filtering unit 370 may apply weight filters having separate weights to frequency bands. For example, the first weight applied to the frequency band of 4 KHz to 8 KHz by the first weight filtering unit 340 may be less than the second weight applied to the frequency band of 6 KHz to 8 KHz by the second weight filtering unit 370, so as to reduce the magnitude of harmonics included in a high-frequency band. However, this is only exemplary, and the first weight applied to the frequency band of 4 KHz to 8 KHz by the first weight filtering unit 340 may be greater than the second weight applied to the frequency band of 6 KHz to 8 KHz by the second weight filtering unit 370.

The signal adding unit 380 generates the second signal by adding the harmonics extracted by the first weight filtering unit 340 and the harmonics extracted by the second weight filtering unit 370. The signal adding unit 380 adds the first signal delayed by a predetermined time by the first signal time delaying unit 310 to the second signal, thereby generating a new speech signal.

As such, according to an exemplary embodiment, the first signal included in the first frequency band is separately extracted as signals of N frequency bands and harmonics included in N frequency bands, each having a size of 1/N times the second frequency band, are extracted among harmonics generated by using the extracted signals of the N frequency bands as fundamental waves, thereby generating the second signal.

According to an exemplary embodiment, N weight filters apply separate weights to frequency bands to extract harmonics, and thus the magnitude of the second signal generated in the second frequency band may be adjusted according to frequency.

Figure 4:
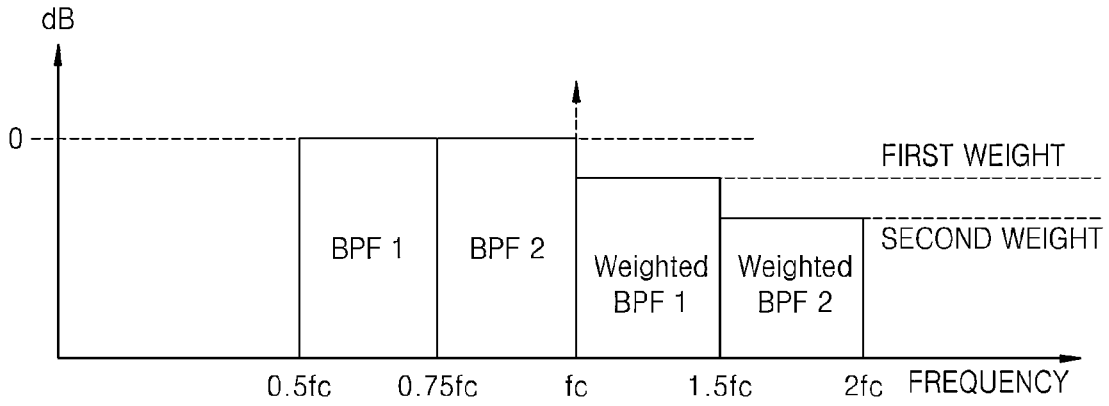
FIG. 4 is a graph showing an example where the extension signal generating unit shown in FIG. 3 generates a signal of a second frequency band by using a signal of a first frequency band and applies a weight to the signal of the second frequency band.

FIG. 4 is a graph showing an example where the extension signal generating unit 250 shown in FIG. 3 generates a signal of the second frequency band by using a signal of the first frequency band and applies a weight to the signal of the second frequency band.

In FIG. 4, the first frequency band where a speech signal is located is assumed to be greater than or equal to 0.5 fc and less than fc. The extension signal generating unit 250 generates a new signal in the second frequency band, which does not overlap with the first frequency band, included in a human-sensitive frequency band, by using the signal of the first frequency band. In FIG. 4, the second frequency band has a size that is twice the size of the first frequency band and is assumed to be greater than or equal to fc and less than 2 fc.

The first filtering unit 320 filters a signal of a frequency band which is greater than or equal to 0.5 fc and less than 0.75 fc from the signal of the first frequency band. The first filtering unit 320 outputs the filtered signal to the first harmonic generating unit 330, and the first harmonic generating unit 330 generates harmonics for the signal of the frequency band filtered by the first filtering unit 320. When 0.5 fc is used as a frequency of a fundamental wave, frequencies of $L^{th}$-order harmonics generated by the first harmonic generating unit 330 may be fc, 1.5 fc, 2 fc, 2.5 fc, and the like. Herein, L is a natural number greater than 2. The first weight filtering unit 340 extracts harmonics included in a frequency band greater than or equal to fc and less than 1.5 fc in the second frequency band from among the harmonics generated by the first harmonic generating unit 330. That is, the first weight filtering unit 340 extracts 2nd-order harmonics, that is, harmonics having a frequency of fc from among the generated $L^{th}$-order harmonics when 0.5 fc is used as a frequency of a fundamental wave.

The first weight filtering unit 340 may adjust the magnitude of the extracted harmonics by applying a weight filter having a first weight to the signal included in the frequency band greater than or equal to fc and less than 1.5 fc.

Likewise, the second filtering unit 350 filters a signal of a frequency band greater than or equal to 0.75 fc and less than fc from the signal of the first frequency band and outputs the filtered signal of the frequency band to the second harmonic generating unit 360. The second harmonic generating unit 360 generates harmonics for the signal of the frequency band filtered by the second filtering unit 320. More specifically, when using 0.75 fc as a frequency of a fundamental wave, the second harmonic generating unit 360 generates $L^{th}$-order harmonics having frequencies such as 1.5 f, 2.25 fc, 3 fc, and so forth. The second weight filtering unit 370 extracts harmonics included in a frequency band greater than or equal to 1.5 fc and less than 2 fc in the second frequency band from among the harmonics generated by the second harmonic generating unit 360. That is, the second weight filtering unit 370 extracts $2^{nd}$-order harmonics, i.e., harmonics having a frequency of 1.5 fc, from among the generated $L^{th}$-order harmonics when using 0.75 fc as a frequency of a fundamental wave.

The second weight filtering unit 370 may adjust the magnitude of the extracted harmonics by applying a weight filter having a second weight to the signal included in the frequency band greater than or equal to 1.5 fc and less than 2 fc.

The first weight of the weight filter used by the first weight filtering unit 340 and the second weight of the weight filter used by the second weight filtering unit 370 may not be the same. For example, the first weight filtering unit 340 and the second weight filtering unit 370 may apply a small weight to a higher-frequency band. When a weight is a real number that is greater than or equal to 0 and less than 1, the first weight is greater than the second weight in FIG. 4.

In another exemplary embodiment, the first weight and the second weight may be variable values which change with the frequency, rather than constant values. That is, the weight filters used by the first weight filtering unit 340 and the second weight filtering unit 370 may be frequency weight filters which apply different weights for different frequencies.

Figure 5:
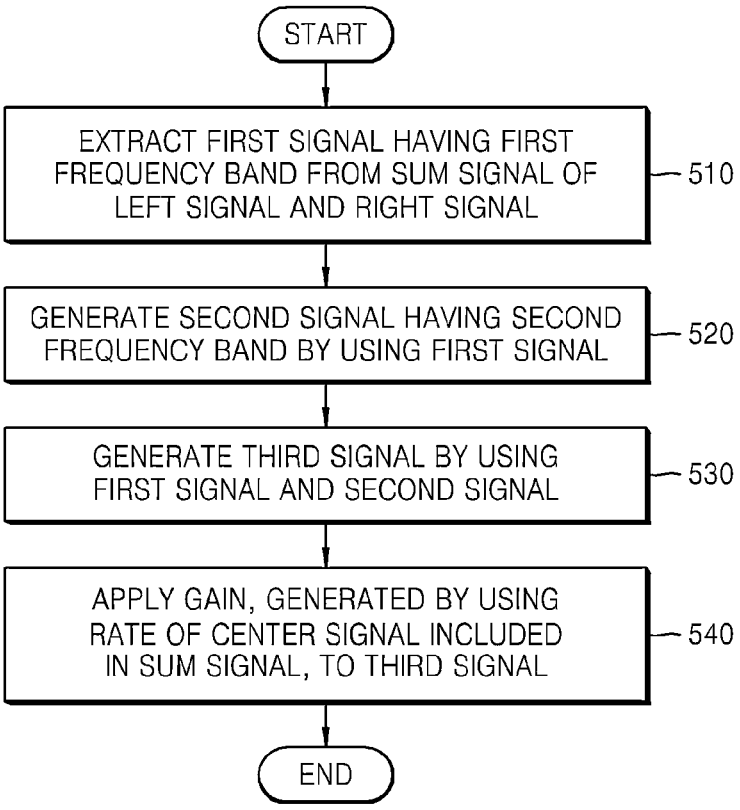
FIG. 5 is a flowchart for describing that the signal processing apparatus shown in FIG. 2 amplifies a speech signal, according to an exemplary embodiment.

FIG. 5 is a flowchart for describing that the signal processing apparatus 200 shown in FIG. 2 amplifies a speech signal, according to an exemplary embodiment. Referring to FIG. 5, the signal processing apparatus 200 obtains the sum signal of the left signal and the right signal and extracts the first signal having the first frequency band from the sum signal in operation 510. The signal processing apparatus 200 generates the second signal having the second frequency band which is different from the first frequency band by using the first signal having the first frequency band in operation 520.

The signal processing apparatus 200 generates a new speech signal, i.e., a third signal, by using the first signal and the second signal in operation 530. The signal processing apparatus 200 may delay the first signal by a predetermined time and add the time-delayed first signal to the second signal, thereby generating the third signal.

The signal processing apparatus 200 calculates a rate of the center signal included in the sum signal and calculates a gain by using the rate of the center signal. The signal processing apparatus 200 applies the gain to the generated third signal in operation 540.

Figure 6:
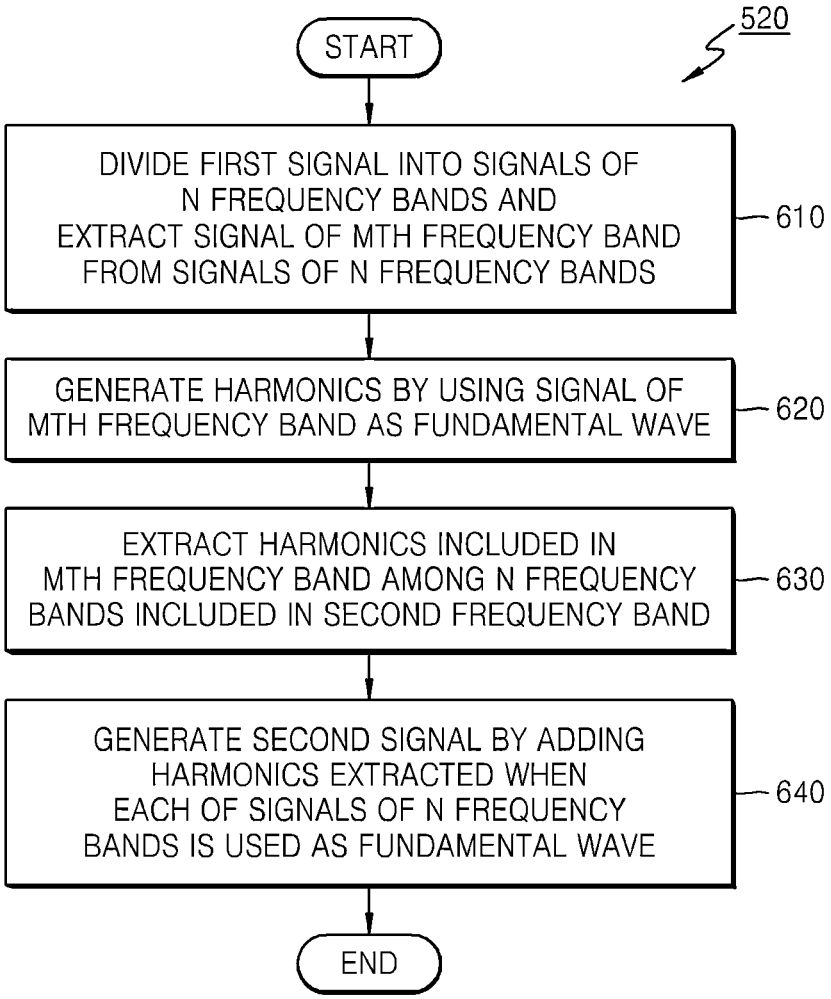
FIG. 6 is a flowchart for describing in more detail an operation of generating a second signal having a second frequency band, shown in FIG. 5, according to an exemplary embodiment.

FIG. 6 is a flowchart for describing in more detail operation 520 shown in FIG. 5, according to an exemplary embodiment. The signal processing apparatus 200 may generate the second signal by regarding the first signal as a signal of a single band, but may generate the second signal by dividing the first signal into signals of a plurality of frequency bands.

When generating the second signal by dividing the first signal into signals of a plurality of frequency bands, the signal processing apparatus 200 divides the first signal into signals of N frequency bands and extracts a signal of an $M^{th}$ frequency band among the signals of the N frequency bands in operation 610.

The signal processing apparatus 200 generates harmonics by using the signal of the $M^{th}$ frequency band as a fundamental wave in operation 620. The signal processing apparatus 200 extracts harmonics included in the $M^{th}$ frequency band among the N frequency bands included in the second frequency band from the generated harmonics in operation 630. The signal processing apparatus 200 generates the second signal by using the harmonics extracted using the signals of the N frequency bands as fundamental waves in operation 640. The signal processing apparatus 200 may adjust the magnitude of the second signal on a frequency basis by applying weight filters having separate weights to harmonics when extracting the harmonics.

Figure 7:
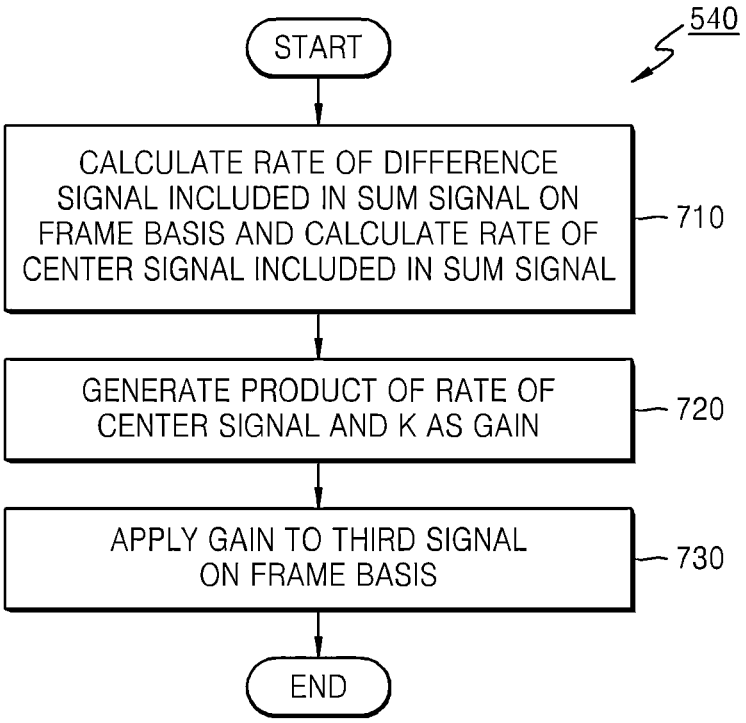
FIG. 7 is a flowchart for describing in more detail an operation of applying a gain, generated by using a rate of center signal included in a sum signal, to a third signal, shown in FIG. 5, according to an exemplary embodiment.

FIG. 7 is a flowchart for describing in more detail operation 540 shown in FIG. 5, according to an exemplary embodiment. The signal processing apparatus 200 generates the sum signal by adding the left signal and the right signal and generates the difference signal by subtracting the left signal from the right signal.

The signal processing apparatus 200 divides the sum signal on a frame basis to obtain a representative value of the sum signal for each frame. To obtain a representative value of the sum signal for each frame, the signal processing apparatus 200 may use various methods such as obtaining a root mean square (RMS) of the sum signal, an average of an absolute value of the sum signal, or an intermediate value of an absolute value of the sum signal, for each frame. Similarly, the signal processing apparatus 200 divides the difference signal on a frame basis and obtains a representative value of the difference signal for each frame.

The signal processing apparatus 200 calculates a rate of the difference signal included in the sum signal by dividing the representative value of the difference signal by the representative value of the sum signal, for each frame. The signal processing apparatus 200 normalizes the rate of the difference signal and subtracts the normalized value from 1, thereby calculating the rate of the center signal included in the sum signal in operation 710.

The signal processing apparatus 200 generates a product of the rate of the center signal and K as a gain for each frame in operation 720. Herein, K is a positive real number. The signal processing apparatus 200 generates the third signal by adding the second signal filtered by a weight filter to the time-delayed first signal, and applies a gain obtained for each frame to each frame of the third signal in operation 730.

According to an exemplary embodiment, the rate of the center signal included in the sum signal is calculated for each frame and a gain generated by using the rate of the center signal is applied to the third signal, thereby adjusting the magnitude of the third signal according to the rate of the center signal included in the stereo signal.

In addition, according to an exemplary embodiment, the magnitude of the second signal is adjusted on a frequency basis by using a weight filter, and the magnitude of the first signal and the magnitude of the second signal are adjusted for each frame by using a gain, whereby signals of a frequency band where a speech signal is located are not amplified at a time, and instead, the magnitude of a speech signal may be adjusted on a frequency band basis and on a frame basis.

Figure 8:
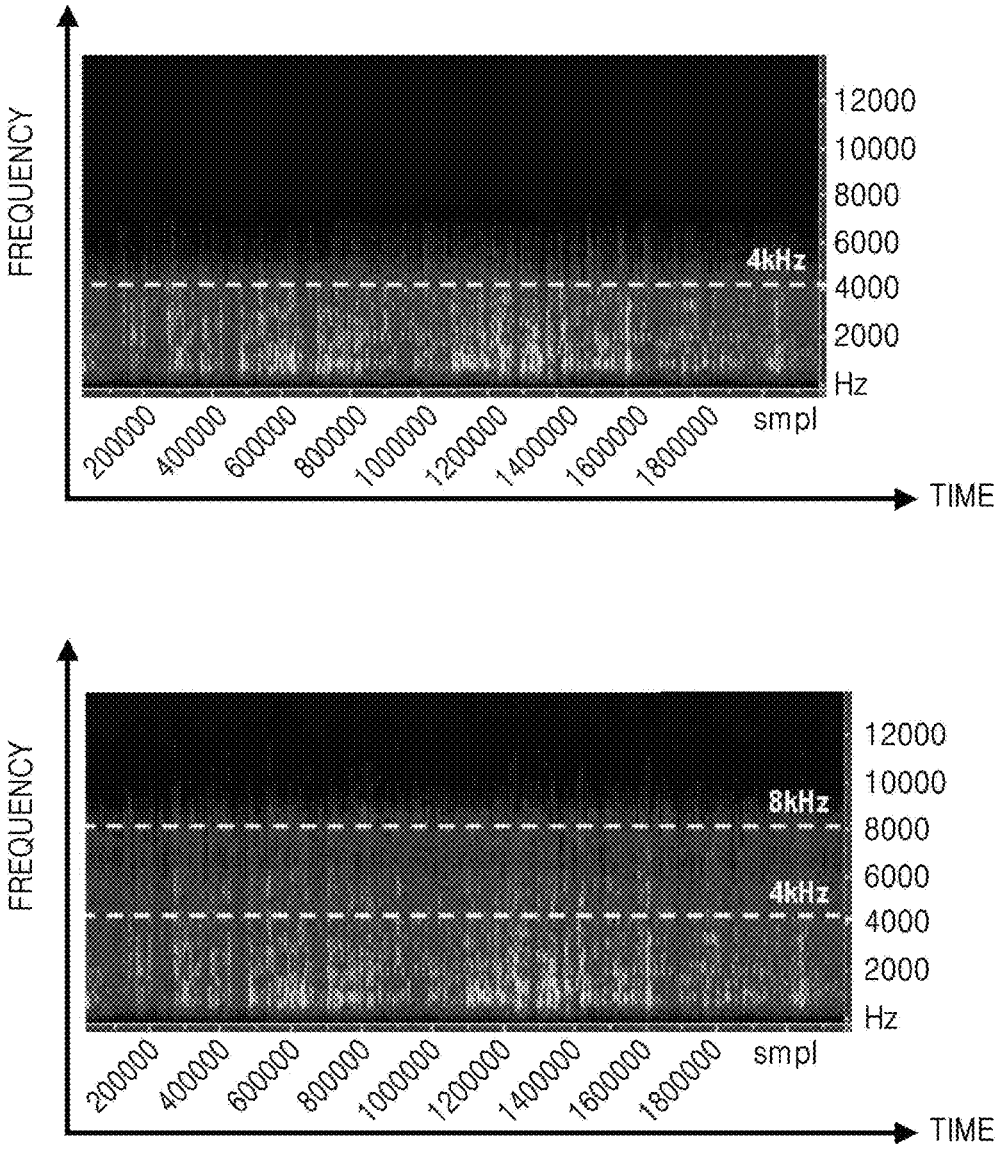
FIG. 8 shows spectrograms for explaining that a speech signal is amplified according to the exemplary embodiments.

FIG. 8 shows spectrograms which illustrate that a speech signal is amplified according to the exemplary embodiment. In the spectrograms shown in FIG. 8, a horizontal axis indicates time, a vertical axis indicates frequency, and a variation in the amplitude of energy with respect to time and frequency is expressed by the color depth. In FIG. 8, an area that contains white and black shades means that energy is full and a dark color portion (as depicted in the upper portions of the spectrograms) means that energy is empty.

The upper spectrogram in FIG. 8 shows a first signal having a first frequency band of a sum signal of a left signal and a right signal. It can be seen from the upper spectrogram that a speech signal is located in a frequency band of up to about 4 KHz.

The lower spectrogram in FIG. 8 shows a third signal generated by using the first signal. The third signal is generated by delaying the first signal by a predetermined time and adding a second signal generated by using the first signal to the time-delayed first signal.

It can be seen from the lower spectrogram of FIG. 8 that the frequency band of the speech signal is extended to a frequency band of up to about 8 KHz. That is, if the first frequency band is 4 KHz, the speech signal included in 4 KHz is extended to the second frequency band which is a human-sensitive frequency band, that is, a frequency band of up to 8 KHz.

As is apparent from the foregoing description, according to an exemplary embodiment, the second signal is generated in the second frequency band by using a speech signal included in the first frequency band, and the first signal and the second signal are used together as a new speech signal, thereby amplifying a speech signal.

The signal processing method and apparatus according to the exemplary embodiments may be embodied as a computer readable code on a computer-readable recording medium. The recording medium may be any data storage device that can store data which can be thereafter read by a computer system. Examples of the recording medium include read-only memory (ROM), random access memory (RAM), CD-ROMs, magnetic tapes, floppy disks, and optical data storage devices. The computer-readable recording medium can also be distributed over a network of coupled computer systems so that the computer-readable code is stored and executed in a decentralized fashion. A function program, code, and code segments for executing the signal processing method can be easily construed by programmers of ordinary skill in the art.

While the aspects have been particularly shown and described with reference to exemplary embodiments thereof, it will be understood by those of ordinary skill in the art that various changes in form and details may be made therein without departing from the spirit and scope of the exemplary embodiments as defined by the following claims. Accordingly, the disclosed exemplary embodiments should be considered in an illustrative sense not in a limiting sense. The scope of the exemplary embodiments is defined not by the detailed description of the exemplary embodiments, but by the appended claims, and all differences within the scope will be construed as being included in the exemplary embodiments.

What is claimed is:

1. A signal processing method of a signal processing apparatus, the method comprising:

extracting, by a first signal extractor, a first signal having a first frequency band from an audio signal including a speech signal;

generating, by an extension signal generator, a second signal having a second frequency band by using the first signal, the second frequency band not overlapping with the first frequency band;

generating a third signal by adding the first signal and the second signal; and applying a gain, generated by using a ratio of the speech signal included in the audio signal, to the third signal, wherein the first signal extractor is implemented as hardware.

2. The signal processing method of claim 1, wherein the generating of the second signal comprises:

generating harmonics for a fundamental wave by using the first signal as the fundamental wave; and generating a signal included in the second frequency band among the harmonics as the second signal.

3. The signal processing method of claim 2, further comprising applying a weight filter to the second signal.

4. The signal processing method of claim 1, wherein the generating of the second signal comprises:

dividing the first signal into signals of N frequency bands and extracting a signal of an $M^{th}$ frequency band from among the signals of the N frequency bands, N being a natural number greater than 2 and M being a natural number less than or equal to N;

generating harmonics by using the signal of the $M^{th}$ frequency band as a fundamental wave;

extracting harmonics included in the $M^{th}$ frequency band among N frequency bands included in the second frequency band from among the generated harmonics; and generating the second signal by adding harmonics extracted from each of the N frequency bands included in the second frequency band when each of the signals of the N frequency bands of the first signal is used as a fundamental wave.

5. The signal processing method of claim 4, further comprising applying a weight filter to the second signal.

6. The signal processing method of claim 5, wherein the applying of the weight filter comprises applying a weight filter having a separate weight for each of the N frequency bands included in the second frequency band, and wherein the weight filter has a small weight for a high-frequency band, the weight being a real number not less than 0 and not more than 1.

7. The signal processing method of claim 5, wherein the applying of the weight filter comprises applying a frequency weight filter having a small weight for a high frequency, the weight being a positive real number not more than 1.

8. The signal processing method of claim 5, wherein the generating of the third signal comprises:

time-delaying the first signal; and generating the third signal by adding the second signal filtered by the weight filter to the time-delayed first signal.

9. The signal processing method of claim 1, wherein the applying of the gain comprises:

calculating a sum signal and a difference signal of a left signal and a right signal on each frame basis;

calculating a rate of the difference signal to the sum signal and calculating a rate of the center signal included in the sum signal by using the rate of the difference signal on a frame basis; and generating a product of the rate of the center signal and K as a gain for each frame, where K is a positive real number.

10. The signal processing method of claim 9, wherein the calculating of the rate of the center signal comprises normalizing the rate of the difference signal included in the sum signal and subtracting the normalized rate from 1, to calculate the rate of the center signal.

11. The signal processing method of claim 9, wherein the applying of the gain comprises applying a gain obtained for each frame to the third signal on a frame basis.

12. The signal processing method of claim 1, further comprising:

time-delaying a left signal and a right signal; and generating a new left signal and a new right signal by adding the signal to which the gain was applied to each of the time-delayed left signal and the time-delayed right signal.

13. The signal processing method of claim 1, wherein the second frequency band has frequency values greater than frequency values of the first frequency band.

14. The signal processing method of claim 1, wherein the second frequency band has a size that is twice the size of the first frequency band.

15. A signal processing apparatus comprising:

a device, and a memory coupled to the device;

a first signal extracting unit which extracts a first signal which has a first frequency band from an audio signal including a speech signal;

a gain generating unit which generates a gain by using a ratio of the speech signal included in the audio signal; and an extension signal generating unit which generates a second signal which has a second frequency band by using the first signal, the second frequency band not overlapping with the first frequency band, generates a third signal by adding the first signal and the second signal, and applies the gain to the third signal, wherein the first signal extracting unit and the gain generating unit are implemented as hardware.

16. The signal processing apparatus of claim 15, wherein the extension signal generating unit generates harmonics for a fundamental wave by using the first signal as the fundamental wave, and generates a signal included in the second frequency band among the harmonics as the second signal.

17. The signal processing apparatus of claim 16, wherein the extension signal generating unit generates the second signal by applying a weight filter to the signal included in the second frequency band among the harmonics.

18. The signal processing apparatus of claim 15, wherein the extension signal generating unit comprises:

a filtering unit which divides the first signal into signals of N frequency bands and extracts a signal of an $M^{th}$ frequency band from among the signals of the N frequency bands, N being a natural number greater than 2 and M being a natural number less than or equal to N; and a harmonic generating unit which generates harmonics by using the signal of the $M^{th}$ frequency band as a fundamental wave;

a weight filtering unit which extracts harmonics included in the $M^{th}$ frequency band among N frequency bands included in the second frequency band from among the generated harmonics; and a signal adding unit which generates the second signal by adding harmonics extracted from each of the N frequency bands included in the second frequency band when each of the signals of the N frequency bands of the first signal is used as a fundamental wave.

19. The signal processing apparatus of claim 18, wherein the weight filtering unit applies a weight filter to the extracted harmonics.

20. The signal processing apparatus of claim 19, wherein the weight filtering unit applies a weight filter which has a separate weight for each of the N frequency bands included in the second frequency band, and wherein the weight filter has a small weight for a high-frequency band, the weight being a real number not less than 0 and not more than 1.

21. The signal processing apparatus of claim 19, wherein the weight filtering unit applies a frequency weight filter having a small weight for a high frequency, the weight being a positive real number not more than 1.

22. The signal processing apparatus of claim 19, wherein the extension signal generating unit further comprises a time delaying unit which time-delays the first signal, and the signal adding unit generates the third signal by adding the second signal filtered by the weight filter to the time-delayed first signal.

23. The signal processing apparatus of claim 15, wherein the gain generating unit calculates a sum signal and a difference signal of a left signal and a right signal on a frame basis, calculates a rate of the difference signal included in the sum signal, calculates a rate of the center signal included in the sum signal by using the rate of the difference signal on a frame basis, and generates a product of the rate of the center signal and K as a gain for each frame, K being a positive real number.

24. The signal processing apparatus of claim 23, wherein the gain generating unit normalizes the rate of the difference signal to the sum signal and subtracts the normalized rate from 1, to calculate the rate of the center signal.

25. The signal processing apparatus of claim 23, wherein the extension signal generating unit applies a gain obtained for each frame to the third signal on a frame basis.

26. The signal processing apparatus of claim 15, further comprising:

a left signal time delaying unit and a right signal time delaying unit which time-delays a left signal and a right signal, respectively; and a stereo signal generating unit which generates a new left signal and a new right signal by adding the signal to which the gain was applied to the time-delayed left signal and the time-delayed right signal.

27. The signal processing apparatus of claim 15, wherein the second frequency band has frequency values greater than frequency values of the first frequency band.

28. The signal processing apparatus of claim 15, wherein the second frequency band has a size that is twice the size of the first frequency band.

29. A non-transitory computer-readable recording medium having embodied thereon instructions that, when executed by a computer, causes the computer to perform a signal processing method, the signal processing method comprising:

extracting a first signal having a first frequency band from an audio signal including a speech signal;

generating a second signal having a second frequency band by using the first signal, the second frequency band not overlapping with the first frequency band;

generating a third signal by adding the first signal and the second signal; and applying a gain, generated by using a ratio of the speech signal included in the audio signal, to the third signal.

* * * * *